US005305921A

United States Patent [19]

Kock et al.

[11] Patent Number: 5,305,921

[45] Date of Patent: Apr. 26, 1994

[54] PACKAGE WITH REPLACEABLE INNER RECEPTACLE HAVING LARGE INTEGRALLY MOLDED FITMENT

[75] Inventors: Ronald W. Kock, Wyoming; William J. Willhite, Cincinnati; Richard D. Satterfield, Bethel, all of Ohio

[73] Assignee: The Procter & Gamble Company, Cincinnati, Ohio

[21] Appl. No.: 120,694

[22] Filed: Sep. 13, 1993

Related U.S. Application Data

[63] Continuation of Ser. No. 809,986, Dec. 18, 1991, abandoned.

[51] Int. Cl.[5] ..... B65D 35/28

[52] U.S. Cl. ..... 222/95; 222/105; 222/321; 222/383; 222/386.5; 222/464

[58] Field of Search ..... 222/94, 95, 105, 153, 222/183, 209, 211, 386.5, 321, 383, 464, 541

[56] References Cited

U.S. PATENT DOCUMENTS

| | | | |
|---|---|---|---|
| 1,965,271 | 7/1934 | Wharton . | |
| 2,556,584 | 6/1951 | Hofmann | 222/105 |
| 2,564,359 | 8/1951 | Fuller | 222/105 |
| 2,608,320 | 8/1952 | Harrison, Jr. | 222/95 |
| 2,671,579 | 3/1954 | Knoblock | 222/105 |
| 2,804,240 | 8/1957 | Anderson | 222/207 |
| 2,804,995 | 9/1957 | Fee | 222/95 |
| 2,859,899 | 11/1958 | Kramer et al. | 222/95 |
| 3,022,920 | 2/1962 | Croom, Jr. | 222/105 |
| 3,118,572 | 1/1964 | Harding | 222/183 |
| 3,172,568 | 3/1965 | Modderno | 222/80 |
| 3,178,060 | 4/1965 | Bossack | 222/78 |
| 3,223,289 | 12/1965 | Bouet | 222/209 |
| 3,225,967 | 12/1965 | Heimgartner | 222/183 |
| 3,240,394 | 3/1966 | Modderno | 222/95 |
| 3,240,399 | 3/1966 | Frandeen | 222/211 |
| 3,245,582 | 4/1966 | Roth et al. . | |
| 3,270,920 | 9/1966 | Nessler | 222/95 |
| 3,275,193 | 9/1966 | Barr | 222/386.5 X |
| 3,294,289 | 12/1966 | Bayne et al. | 222/95 |
| 3,297,205 | 1/1967 | Sumner | 222/102 |
| 3,306,500 | 2/1967 | Williams | 222/209 |
| 3,313,455 | 4/1967 | Kemmer | 222/103 |
| 3,342,377 | 9/1967 | Peredy | 222/94 |
| 3,486,661 | 12/1969 | Friedrich et al. | 222/95 |
| 3,493,179 | 2/1970 | Lee | 239/327 |
| 3,587,937 | 6/1971 | Childs | 222/213 |
| 3,592,365 | 7/1971 | Schwartzman | 222/209 |

(List continued on next page.)

FOREIGN PATENT DOCUMENTS

| | | | |
|---|---|---|---|
| 961015 | 1/1975 | Canada | 222/211 |
| 86/00868 | 2/1986 | European Pat. Off. . | |
| 0182094 | 5/1986 | European Pat. Off. . | |
| 368112A | 4/1989 | European Pat. Off. . | |
| 1042850 | 6/1954 | Fed. Rep. of Germany . | |
| 188643 | 1/1957 | Fed. Rep. of Germany . | |
| 2129736 | 6/1971 | Fed. Rep. of Germany . | |
| 2081244 | 3/1971 | France . | |
| 2134871 | 12/1972 | France | 222/325 |
| 1255159 | 6/1991 | France . | |
| 1132709 | 11/1968 | United Kingdom | 222/325 |

*Primary Examiner*—Kevin P. Shaver

*Attorney, Agent, or Firm*—Michael E. Hilton; John M. Howell; Ronald W. Kock

[57] ABSTRACT

An inner receptacle having a single integral piece flexible bag including a thin walled portion and a rigid fitment portion. The fitment portion includes a flange which is larger in diameter than the flexible bag to provide a mechanism to attach the inner receptacle to a bottle. The fitment portion also provides a finger grasping portion. The inner receptacle may be utilized in, for example, a squeeze pump package, a trigger or finger pump package, or a mechanical pump package. The inner receptacle also includes a mechanism for enabling substantially all of the product therein to be dispensed. One such mechanism is provided by a perforated diptube. Another such mechanism is provided by the combination of a resiliently deformable upper half and a collapsible lower half to cause the flexible bag to invert upon itself. These single integral piece flexible bags are preferably made by a modified pressblowing process wherein an increased range of motion is provided by a rack and pinion mechanism to enable formation of the large flange.

6 Claims, 8 Drawing Sheets

U.S. PATENT DOCUMENTS

| | | | |
|---|---|---|---|
| 3,648,903 | 3/1972 | Marchant | 222/212 |
| 3,656,660 | 4/1972 | Mueller | 222/94 |
| 3,709,437 | 1/1973 | Wright | 239/343 |
| 3,726,436 | 4/1973 | Despain et al. | 222/213 |
| 3,784,039 | 1/1974 | Marco | 222/105 X |
| 3,837,533 | 9/1974 | Splan | 222/105 X |
| 3,847,308 | 11/1974 | Tambor | 222/386.5 |
| 3,870,198 | 3/1975 | Cohen | 222/105 |
| 3,880,326 | 4/1975 | Kennard et al. | 222/95 |
| 3,896,970 | 7/1975 | Laauwe | 222/94 |
| 3,938,709 | 2/1976 | Collar | 222/95 |
| 3,973,701 | 8/1976 | Gardner | 222/190 |
| 3,995,772 | 12/1976 | Liautaud | 222/83.5 |
| 4,013,195 | 3/1977 | Ferris | 222/95 |
| 4,020,978 | 5/1977 | Szczepanski | 222/209 |
| 4,047,642 | 9/1977 | Nilson | 222/95 X |
| 4,057,177 | 11/1977 | Laauwe | 222/215 |
| 4,062,475 | 12/1977 | Harris et al. | 222/95 |
| 4,087,023 | 5/1978 | Szczepanski | 222/209 |
| 4,089,443 | 5/1978 | Zrinyi | 222/386.5 |
| 4,098,434 | 7/1978 | Uhlig | 222/94 |
| 4,102,476 | 7/1978 | Loeffler | 222/209 |
| 4,133,457 | 1/1979 | Klassen | 222/212 |
| 4,138,036 | 2/1979 | Bond | 222/105 |
| 4,139,124 | 2/1979 | Ferrante | 222/110 |
| 4,147,278 | 4/1979 | Uhlig | 222/94 |
| 4,147,306 | 4/1979 | Bennett | 239/327 |
| 4,154,366 | 5/1979 | Acres | 222/95 |
| 4,159,790 | 7/1979 | Bailey | 222/211 |
| 4,213,545 | 7/1980 | Thompson et al. | 222/386.5 |
| 4,266,698 | 5/1981 | Rausing | 222/528 |
| 4,286,636 | 9/1981 | Credle | 141/114 |
| 4,286,735 | 9/1981 | Sneider | 222/189 |
| 4,293,353 | 10/1981 | Pelton et al. | 156/629 |
| 4,295,582 | 10/1981 | Acres | 222/213 |
| 4,322,020 | 3/1982 | Stone | 222/95 |
| 4,340,157 | 7/1982 | Darner | 222/211 |
| 4,428,508 | 1/1984 | Gardikas et al. | 222/153 |
| 4,457,455 | 7/1984 | Meshberg | 222/105 |
| 4,461,454 | 7/1984 | Vadnais | 251/350 |
| 4,469,250 | 9/1984 | Evezich | 222/83.5 |
| 4,513,891 | 4/1985 | Hain et al. | 222/213 |
| 4,562,942 | 1/1986 | Diamond | 222/386.5 |
| 4,620,648 | 11/1986 | Schwartzman | 222/490 |
| 4,657,151 | 4/1987 | Cabernoch | 215/11 E |
| 4,658,989 | 4/1987 | Bonerb | 222/105 |
| 4,671,428 | 6/1987 | Spatz | 222/105 |
| 4,730,751 | 3/1988 | Mackles et al. | 222/189 |
| 4,760,937 | 8/1988 | Evezich | 222/95 |
| 4,776,492 | 10/1988 | Gallo | 222/183 |
| 4,785,974 | 11/1988 | Rudick et al. | 222/105 |
| 4,809,884 | 3/1989 | Stackhouse | 222/153 |
| 4,842,165 | 6/1989 | Van Coney | 222/95 |
| 4,865,224 | 9/1989 | Streck | 222/95 |
| 4,909,416 | 3/1990 | Evezich | 222/95 |
| 4,936,490 | 6/1990 | Battegazzore | 222/205 |
| 4,949,871 | 8/1990 | Flanner | 222/95 |
| 5,004,123 | 4/1991 | Stoody | 222/105 X |
| 5,005,733 | 4/1991 | Stoody | 222/105 |
| 5,012,956 | 5/1991 | Stoody | 222/95 X |
| 5,031,384 | 7/1991 | Rebeyrolle et al. | 222/95 X |
| 5,100,027 | 3/1992 | Gueret | 222/105 |
| 5,108,007 | 4/1992 | Smith et al. | 222/95 |
| 5,139,168 | 8/1992 | Gueret | 222/105 |
| 5,156,300 | 10/1992 | Spahni et al. | 222/105 |

PACKAGE WITH REPLACEABLE INNER RECEPTACLE HAVING LARGE INTEGRALLY MOLDED FITMENT

This is a continuation of application Ser. No. 07/809,986, filed on Dec. 18, 1991, now abandoned.

BACKGROUND OF THE INVENTION

1. Field of the Invention

The present invention relates to dispensing packages which incorporate an inner receptacle including a flexible fluid product-containing bag; and more particularly, to such packages wherein the inner receptacles are replaceable.

2. Description of the Prior Art

Several types of dispensing packages are known which include an inner receptacle. Such packages are commonly referred to as bag-in-bottle packages. Bag-in-bottle packages have incorporated various dispensing mechanisms, including squeeze-pump packages such as disclosed in U.S. Pat. No. 4,842,165 issued to Van Coney on Jun. 27, 1989; and trigger sprayer packages such as disclosed in U.S. Pat. No. 5,004,123 issued to Stoody on Apr. 2, 1991.

In addition, some prior bag-in-bottle packages have acknowledged the benefits of enabling reuse of the outer package by enabling replacement of an empty inner receptacle with a new, full inner receptacle. Thus, the bulk of the package becomes reusable which reduces packaging costs to the manufacturer and to the environment. For example, U.S. Pat. No. 5,004,123 issued to Stoody on Apr. 2, 1991 discloses such a replaceable inner receptacle for use with a trigger sprayer or finger pump bag-in-bottle package. The disclosed inner receptacle, however, is made of multiple separate and distinct components which must be attached together in a sealed manner. In particular, the body of the flexible bag (which is made of a tubular flexible material) must be sealed to a rigid fitment in an air tight manner around the entire curved circumferential surface of the fitment.

U.S. Pat. No. 2,608,320, issued to Harrison on Aug. 26, 1952, discloses another bag-in-bottle package which has a replaceable inner receptacle. This package operates as a squeeze pump. Like Stoody, the inner receptacle of Harrison is made of multiple separate and distinct components. In particular, a thinner, flexible, lower bag portion is sealed in an air tight manner to an upper, thicker, rigid, bag portion around the entire curved circumferential surface of the bag.

One disadvantage with these and similar inner receptacles is the requirement of sealing at the connection of the individual parts; particularly between curved surfaces. Such connections, lo whether welded, clamped, glued, etc., will generally lack the strength and/or air-tight integrity of a similar receptacle having a one-piece integral molded construction, and it will likely require difficult and costly assembly. For example, heat sealing curved surfaces usually requires multiple overlapping sealing steps because of the difficulty of applying uniform sealing pressure to curved surfaces.

Another disadvantage of the previously-discussed inner receptacles is their lack of a feature to enable the consumer to easily handle them; particularly, when removing an empty inner receptacle. Once the inner receptacle of Stoody or Harrison is seated in the outer bottle, the flange provides very little in the way of a grasping surface to enable removal of the inner receptacle from the outer bottle.

SUMMARY OF THE INVENTION

In accordance with one aspect of the present invention a replaceable inner receptacle is provided for use in an outer bottle having a large finish. The inner receptacle includes a single integral piece flexible bag which is adapted to contain a fluid product. This single integral piece flexible bag includes a thin walled portion which has a thickness small enough that the thin walled portion readily collapses. In addition, this single integral piece flexible bag includes a relatively thick fitment portion which has a fluid passage therethrough which provided fluid communication with the interior of the flexible bag. The fitment portion also includes a flange which has an overall dimension greater than the overall dimension of the thin walled portion of the flexible bag. The periphery of the flange is adapted to attach to the large finish of the outer bottle. The inner receptacle also includes means for enabling substantially all of the fluid within the flexible bag to be dispensed.

In accordance with another aspect of the present invention a replaceable inner receptacle is provided for use in an outer bottle. The inner receptacle includes a single integral piece flexible bag which is adapted to contain a fluid product. This single integral piece flexible bag includes a thin walled portion which has a thickness small enough that the thin walled portion readily collapses. In addition, this single integral piece flexible bag includes a relatively thick fitment portion which has a fluid passage therethrough which provided fluid communication with the interior of the flexible bag. The fitment portion also includes a flange and a grasping portion which extends above the flange to provide means for grasping and removing the inner receptacle from the bottle. The inner receptacle also includes means for enabling substantially all of the fluid within the flexible bag to be dispensed.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENT

Figure 1:
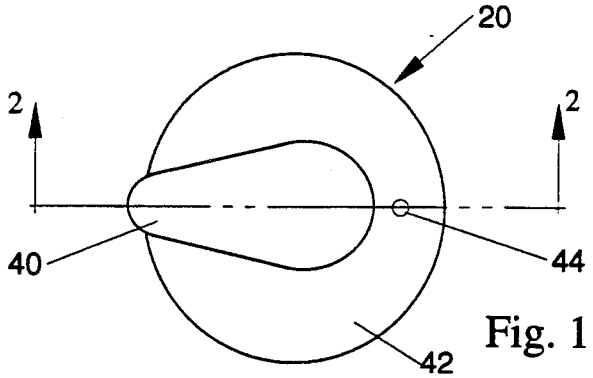
FIG. 1 is a top plan view of a preferred embodiment of an inner receptacle of the present invention.
Figure 2:
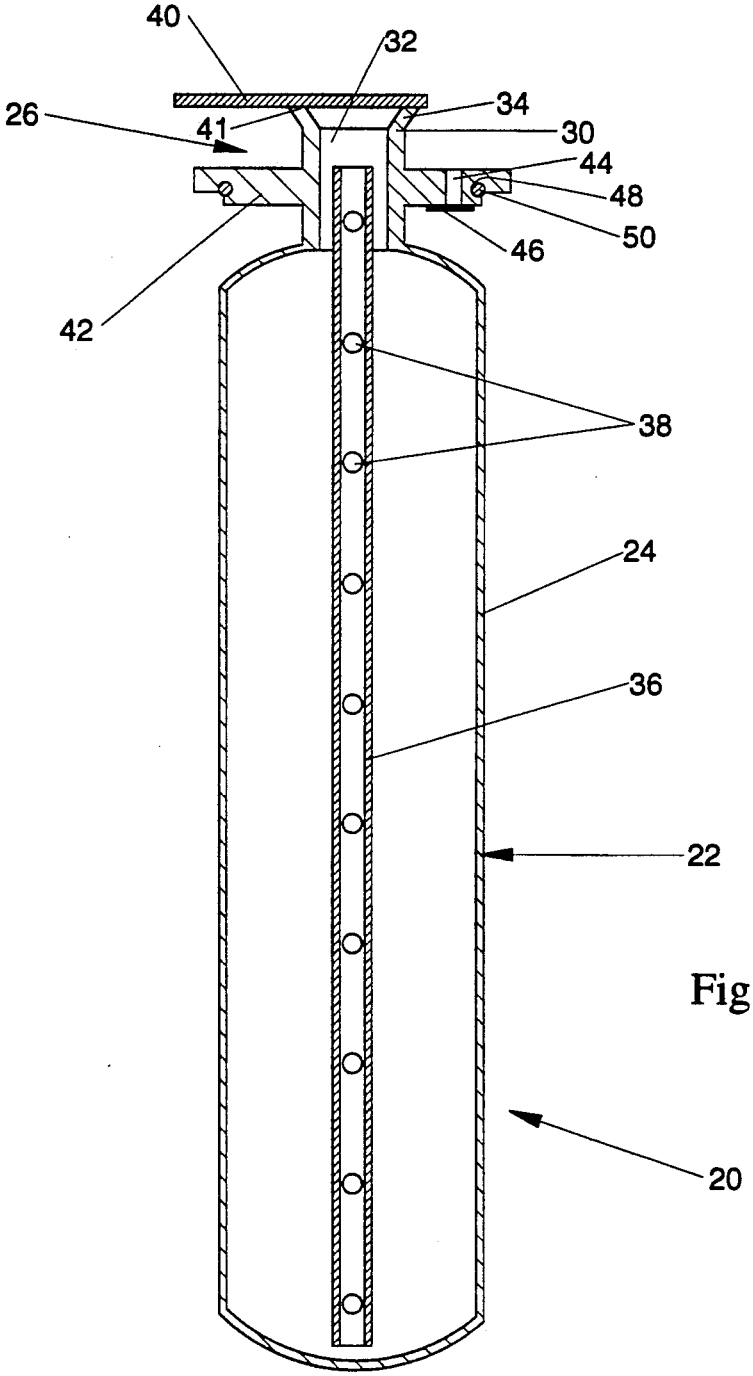
FIG. 2 is a cross-sectional elevation view of the inner receptacle of FIG. 1, taken along section line 2—2 of FIG. 1.

A particularly preferred inner receptacle of the present invention, indicated generally as 20, is illustrated in FIG. 1 and FIG. 2. Basically, inner receptacles 20 of the present invention have a flexible bag 22 which includes a thin walled flexible bag portion 24 and a relatively thick, rigid fitment portion 26. Moreover, it is an important feature of inner receptacles 20 of the present invention that the fluid containing components of the inner receptacle 20 (i.e., the flexible bag 22 including the rigid fitment portion 26 and the thin walled portion 24 of the flexible bag 22) be a single integral piece. Consequently, there is no need for fluid tight seals which may afford pin hole leaks or stress cracks. This configuration provides significant advantages, including significantly improved structural integrity and manufacturing ease. Preferably, these one-piece integral flexible bags 22 are molded utilizing a pressblowing apparatus and process as described hereinafter.

The thin walled portion 24 of the flexible bag 22 of the inner receptacle 20 of FIGS. 1 and 2 includes the entire body of the flexible bag 22 which is circular in horizontal cross-section. The thin walled portion 24 of inner flexible bags 22 of the present invention is thin enough that they readily collapse as fluid is dispensed therefrom. In addition, the thickness of the thin walled portion 24 should be great enough that wrinkles don't develop trapping fluid therein. Preferably, this thickness is from about 0.015 inch to about 0.003; and more preferably, from about 0.007 inch to about 0.007 inch.

This thin walled portion 24 is a single integral piece with the rigid fitment portion 26 located at the upper end of the flexible bag 22. The fitment portion 26 has a cylindrical wall portion 30 surrounding a fluid passage 32 which provides communication with the interior of the flexible bag 22. At the upper end of the cylindrical wall portion 30 is a flared upper end portion 34. The flared upper end portion 34 provides a flat annular upwardly facing surface for sealing as described hereinafter.

Figure 5:
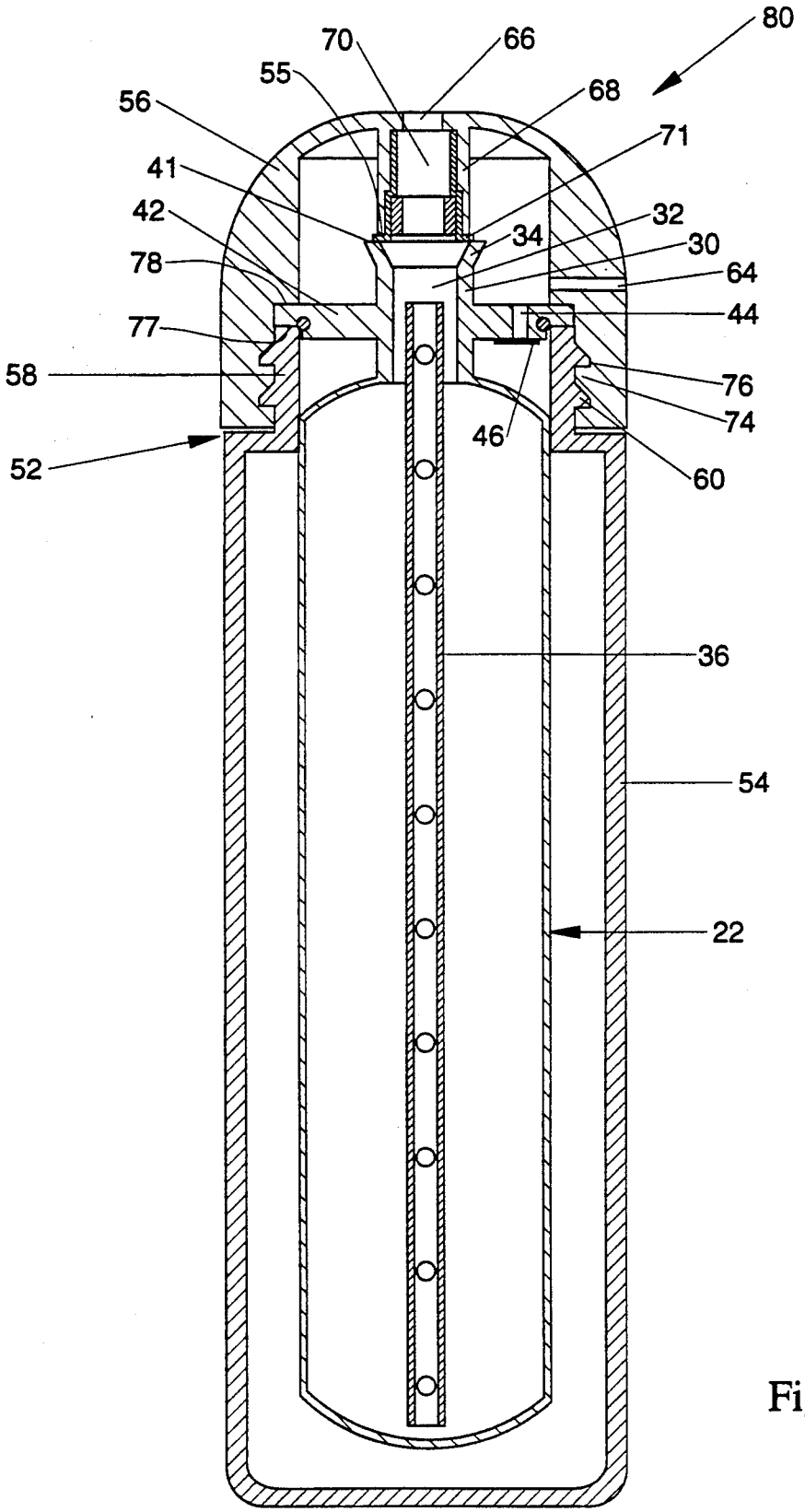
FIG. 5 is a cross-sectional elevation view similar to FIG. 4, of an assembled squeeze pump package utilizing the inner receptacle of FIG. 2 and the squeeze bottle of FIG. 3.

Furthermore, the cylindrical wall portion 30, including the flared upper end 34, provides means for grasping the inner receptacle 20 so that the inner receptacle 20 may be easily manipulated; particularly during removal from the remainder of the squeeze pump package 80 (seen in FIG. 5). To make the fitment portion 26 easy to grasp, the height of the cylindrical wall 30 (including the upper flared portion 34) should be great enough that it provides means for easily grasping the inner receptacle 20. Preferably, this height is about 0.5 inch or more. In addition, this configuration may be utilized to handle the flexible bag 22 during manufacturing and filling operations.

It is highly preferable that the thin walled portion 24 of flexible bags 22 of the present invention cooperate with other portions of the inner receptacle 20 such that substantially all of the product within the flexible bag 22 is dispensed. Thus, the inner receptacle 20 highly preferably includes means for enabling substantially all of the fluid within the flexible bag 24 to be dispensed.

In this illustrated inner receptacle 20 a perforated diptube 36 provides this means. The perforated diptube 36 is located loosely in the fluid passage 32; either before or after filling. If before filling, a filling nozzle is preferably inserted slightly inside the diptube 36. The diptube 36 has a length such that when it contacts the bottom of the flexible bag 22, its upper end remains within the fluid passage 32. Since the diptube 36 is loosely inserted in the passage 32, the diptube 36 is easy to assemble with the flexible bag 22.

The diptube 36 acts to avoid the premature collapse of the thin walled portion 24 of the flexible bag 22 as product is dispensed therefrom, thereby providing a means for enabling substantially all of the product to be dispensed from the inner receptacle 20. Fluid from all parts of flexible bag 22 can reach the fluid passage 32 via the diptube 36, as the thin walled portion 24 of the flexible bag 22 collapses, without being choked off. Perforations 38 in the diptube 36 provide entry points for fluid all along the diptube length. This reduces the resistance of the diptube 36 to fluid flow, since all of the fluid does not have to enter the lower end of the diptube 36 and flow through its entire length.

A peelable film tear tab 40 provides a means for initially sealing the fluid passage 32 of the filled inner receptacle 20. This means 40 prevents fluid and the diptube 36 from exiting the inner receptacle 20 during shipping and handling. The peelable film tear tab 40 is releasably sealed to the flat annular upwardly facing surface 41 of the flared portion 34 covering the fluid passage 32; preferably by pressure sensitive adhesive. The seal is preferably strong enough to maintain the inner receptacle 20 sealed during shipping and handling, but weak enough that the tear tab 40 can be readily removed for use by grasping an unsealed grasping portion of the peelable film tear tab 40. In an alternative configuration (not seen), the film 40 may be permanently sealed to the flat annular upwardly facing surface of the flared portion 34 and punctured for use as discussed hereinafter.

A large flat circular flange 42 extends transversely exteriorly from the cylindrical wall portion 30. The large flange 42 of inner receptacles 20 of this invention preferably has an overall dimension greater than the overall dimension of the thin walled portion 24 of the flexible bag 22. In other words, the large flange 42 extends transversely at least partially beyond the sides of the flexible bag 22 such that the flange 42 can be used to secure the inner receptacle 20 to the remainder of the package as discussed hereinafter. In addition, the flange 42 may be used to support the inner receptacle 20 during, for example, filling and shipping.

A vent hole 44 is located in the large circular flange 42 of this embodiment. This vent hole 44 may be made by punching or drilling from the underside of the flange 42. Preferably, the vent hole 44 is punched so that there are no protrusions remaining around the periphery of the vent hole 44. Located underneath the vent hole 44 and attached intermittently to the underside of the flange 42 is a piece of thin film 46, preferably made of the same family of materials as the flange 42. The vent hole 44 and the thin film 46 operate as a vent hole 44/thin film 46 vent valve. The film 46 is preferably microporous to permit elevation changes without pressurizing the flexible bag 22 causing inadvertent dispensing.

The large flange 42 of this embodiment also has a recessed groove 48 located around the circumference thereof and adapted to accept an o-ring 50. Referring to FIG. 5, the o-ring 50 fits just inside the finish 58 of the bottle 54 when the inner receptacle 20 is placed in the squeeze bottle 54. The o-ring's 50 resilience helps to seal the bottle opening 62 in a substantially air tight manner as discussed hereinafter.

An exemplary inner receptacle 20 appearing as illustrated in FIGS. 1 and 2 may be made of low density polyethylene and have a capacity of 6.25 fl. oz. (177.4 ml). A length of approximately 6 inches (15.2 cm) and a diameter of 1.6 inches (4 cm) could provide the desired volume. Wall thickness of the thin walled portion 24 of the flexible bag 22 may be about 0.006 inch (0.152 mm) except at the top and bottom ends where it could be thicker due to process parameters. The rigid fitment portion 26 might have a flange 42 diameter of 1.71 inch (4.34 cm) and a flange thickness of 0.19 inch (0.48 cm). The vent hole 44 may have a diameter of 0.06 inch (0.15 cm) and the thin film material may be a 0.5 inch (1.27 cm) square of low density polyethylene film 0.001 inch (0.025 mm) thick. The thin film material may be spot sealed in 4 to 6 places in a circle of about 0.38 inch (0.97 cm), centered on the vent hole 44. The spot seals can be made one at a time by a hot soldering iron with a pointed tip, or simultaneously by an ultrasonic horn and anvil. The cylindrical wall 30 may have a length of 0.5 inch (1.27 cm) and an outside diameter of 0.5 inch (1.27 cm) to 0.75 inch at the flared portion 34 (1.91 cm). The diameter of the fluid passage 32 could be 0.25 inch (0.64 cm) to 0.38 inch (0.97 cm) at the upper end.

Figure 3:
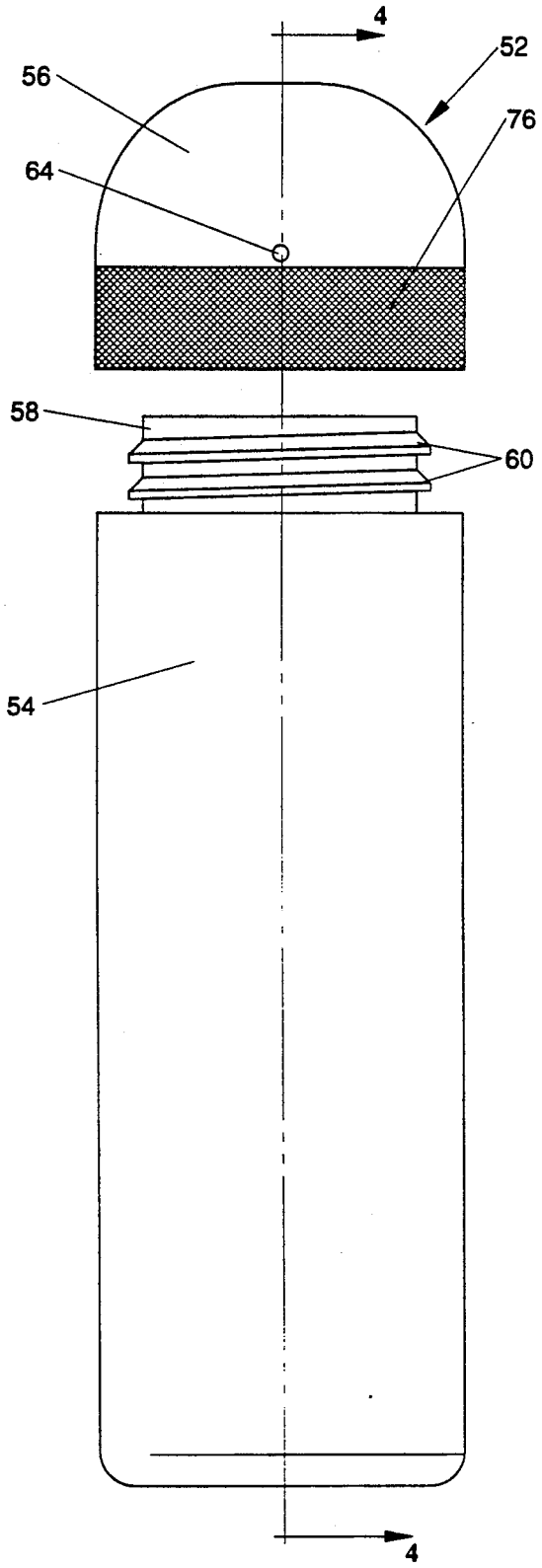
FIG. 3 is an exploded elevation view of a squeeze bottle including a bottle portion and a threaded closure.
Figure 4:
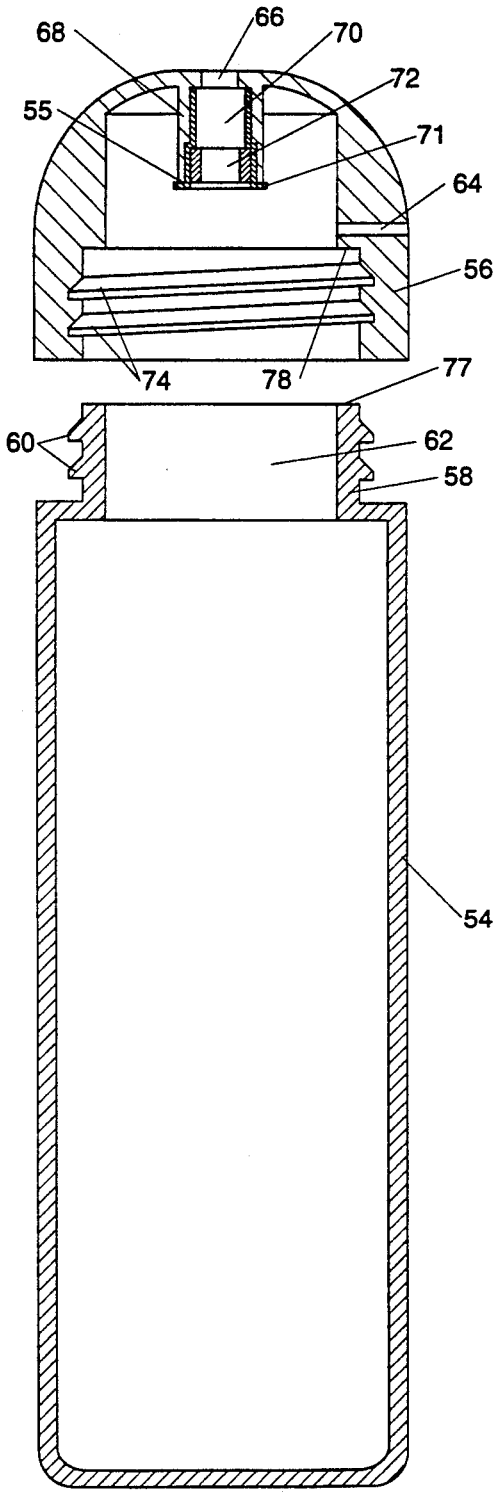
FIG. 4 is a cross-sectional exploded elevation view of the squeeze bottle of FIG. 3, taken along section line 4—4 of FIG. 3.

Referring to FIG. 3 and FIG. 4, the previously described inner receptacle of FIGS. 1 and 2, may be advantageously utilized in a particularly preferred embodiment of an outer squeeze bottle, indicated generally as 52. The outer squeeze bottle 52 includes a cylindrical bottle portion 54 and a threaded closure 56. The illustrated cylindrical bottle portion 54 includes a finish 58 which is circular in horizontal cross-section. This circular shape is advantageous as it permits the use of screw threads 60 which is preferred when the flange 42 must be sealed in a substantially air tight manner to the squeeze bottle 52 such as with a squeeze pump package 80 (seen in FIG. 5).

The finish 58 surrounds an aperture 62 which preferably has the largest possible internal diameter to allow the largest possible inner receptacle 20 to be inserted into the bottle portion 54. The internal diameter of the bottle portion 54 of this embodiment is slightly larger than the internal diameter of the finish 58, so there is no interference when an inner receptacle 20 is inserted. In addition, although the remainder of the squeeze bottle portion 54 may have any horizontal cross-sectional shape, such as oval, circular is preferred. This configuration provides a minimum amount of air space between the squeeze bottle portion 54 and the inner receptacle 20.

The threaded closure 56 includes an open vent hole 64, a centrally located dispensing orifice 66, an internal depending annular wall 68, a product valve 70, a product valve housing 72, internal threads 74, and an external indented or raised grip pattern 76. Located inside the internal depending annular wall 68 is the product valve 70 (in this case a duckbill valve with an extended flange 71) which is held in place preferably by press fitting the housing 72 therein. The duckbill product valve 70 is snap-fit into the depending wall 68 such that fluid may only pass from inside to outside. Alternatives to the illustrated duckbill product valve 70, include a ball check valve, and a suckback valve similar to that disclosed in U.S. Pat. No. 4,842,165 issued to Van Coney on Jun. 27, 1989.

The discharge orifice 66 is located about a millimeter away from the product valve 70. The discharge orifice 66 is preferably sized according to the dose intended for each actuation of the squeeze pump. Typically, the smaller the dose, the smaller the orifice 66 size. Multiple orifices 66 may be useful for some applications.

Referring to FIG. 5, the inner receptacle 20 is inserted into the bottle portion 54 to provide a squeeze pump package, indicated generally as 80. The large flange 42 rests upon the bottle finish 58 of the bottle portion 54. Then, the threaded closure 56 is attached. The raised grip pattern 76 (seen in FIG. 3) assists in tightly securing the closure 56 to the squeeze bottle portion 54 with cooperating screw threads, 60 and 74. These cooperating screw threads 60 and 74 act as a wedge to clamp the periphery of the large flange 42 between parallel surfaces 77 and 78. The o-ring 50 fits just inside the finish 58 when the flange 42 is clamped by the squeeze bottle 52. The o-ring's 50 resilience helps to seal the bottle 52 and the inner receptacle 20 in a substantially air tight manner.

Another alternative (not seen) to enhancing substantially air tight sealing, which avoids the o-ring 50, is to provide the flange 42 with an inward taper around its periphery from top to bottom and providing a matching taper inside the finish 58 of the squeeze bottle portion 54. Although not illustrated, such matching tapered sealing surfaces are common, for example, in laboratory glassware. When the closure clamps against the top of the flange, the taper provides a wedge to amplify the contact force between flange and finish.

In addition to sealing the large flange 42 to the finish 58, tightening of the closure 56 seals the internal depending annular wall 68 to the cylindrical wall 30 of the inner receptacle 20. As the closure 56 is tightened, the downward surface 55 of the annular depending wall 68 forces the annular flange 71 of the product valve 70 against the upward surface 41 of the cylindrical wall 30 which causes the flange 42 to deflect downward slightly. This elastic deflection results in the large flange 42 acting as a spring to maintain pressure of the surfaces, 41 and 55, against the flange 71 of the product valve 70, thereby compression sealing the annular depending wall 68 and the cylindrical wall 30 in a substantially air tight manner. Sealing these parts (68 and 30) together provides fluid communication from the inner receptacle 20 to the atmosphere through the dispensing orifice 66 of the closure 56. In another alternative (not seen), the surfaces, 41 and 55, contact each other directly to form this seal.

In an alternative configuration (not seen), the fluid passage 32 could be enlarged and the annular depending wall 68 could be lengthened such that the annular depending wall slides into the fluid passage such that a seal is created by interference between the inner perimeter of the fluid passage and the outer perimeter of the annular depending wall. In addition, as the annular depending wall is inserted into the fluid passage it could be adapted to puncture any permanently sealed film utilized to seal the fluid passage.

To operate the squeeze pump package 80, a squeezing force is provided against the resiliently deformable side walls of the squeeze bottle portion 54. This squeeze force causes the vent hole 44/thin film 46 vent valve to close and the air between the flexible bag 22 and the squeeze bottle portion 54 to be compressed. This creates increased air pressure around the flexible bag 22 which causes it to collapse against the fluid product. The fluid product will then be forced to flow through and around the loosely inserted diptube 36; through the fluid product valve 70; and out of the squeeze pump package 80 through the discharge orifice 66.

Upon releasing the squeeze force, the resiliently deformable side walls of the squeeze bottle portion 54 return toward their original shape. This return generates a small vacuum inside bottle portion 54. The product valve 70 closes, preventing air from entering the flexible bag 22 via the discharge passage 32. Thus, atmospheric air is drawn into the space between the flexible bag 22 and the squeeze bottle portion 54 through the open vent hole 64 of the closure 56 and then through vent hole 44/thin film 46 vent valve located in the large flange 42. The small vacuum acts to lift the film 46 away from the hole 44 to admit outside air. A similar valve is disclosed in U.S. Pat. No. 4,842,165 issued to Van Coney on Jun. 27, 1991. Other types of vent valves can be substituted for the vent hole 44/thin film 46 valve; including rubber duckbills, umbrella valves, and ball check valves. In addition, the vent valve need not be located in the flange 42. For example, in another alternative, (not seen) the vent valve may be located in the bottle portion 54.

Once the inner receptacle 20 is empty, the empty inner receptacle 20 can be replaced with a full replacement inner receptacle 20. Both of the inner receptacle's 20 seals to the bottle 52 (i.e., flange 42 to bottle finish 58 and cylindrical wall 30 to depending wall 68) can easily be broken for replacement of the inner receptacle 20 merely by unscrewing the closure 56 from the bottle portion 54. Once the closure 56 is removed the cylindrical wall 30 of the rigid fitment portion 26 provides a means for enabling grasping of the inner receptacle 20 for removal. The cylindrical wall 30 with its flared end portion 34 provides a handle which is easily grasped between the thumb and forefinger such that significant force may be utilized to remove the inner receptacle 20.

Figure 6:
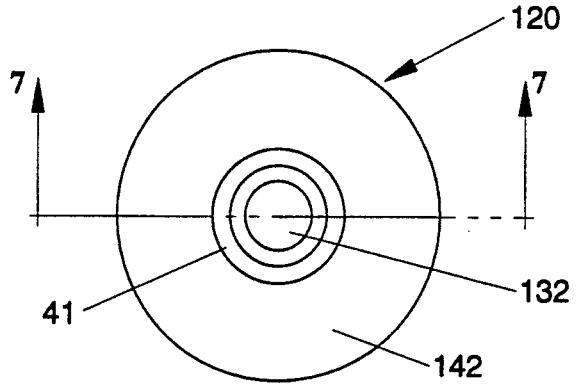
FIG. 6 is a top plan view of a second preferred inner receptacle of the present invention.
Figure 7:
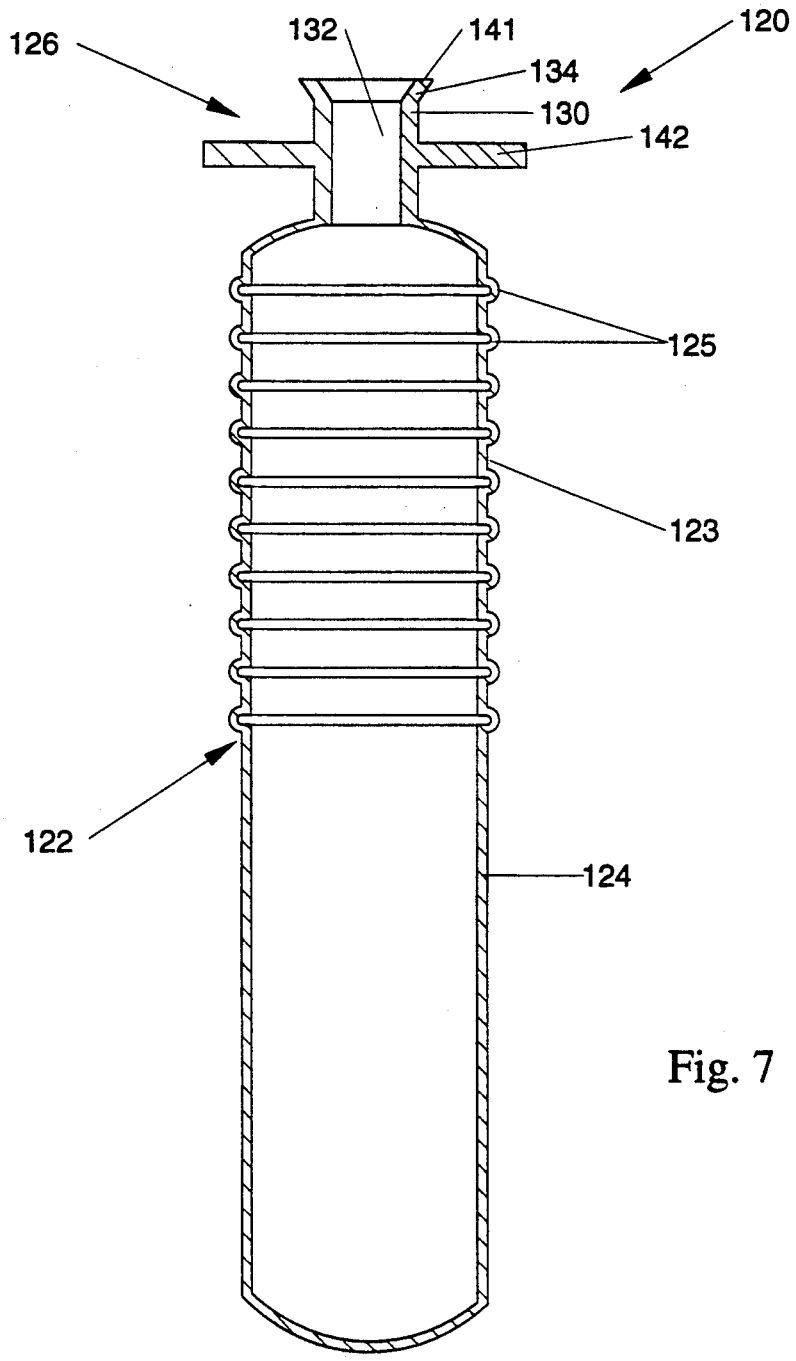
FIG. 7 is a cross-sectional elevation view of the inner receptacle of FIG. 6, taken along section line 7—7 of FIG. 6.

Referring to FIGS. 6 and 7, a second preferred embodiment of an inner receptacle of the present invention, indicated generally as 120, is provided. Starting at the top of the inner receptacle 120, the rigid fitment portion 126 of this embodiment is generally similar to that discussed above. However, the large circular flange 142 does not include the vent hole 44/thin film 46 vent valve and does not include the recessed groove 48 for accepting an o-ring 50. These elements are unnecessary since this inner receptacle 120 is utilized with a fluid suction device (e.g., a finger or trigger sprayer, or a mechanical pump) as discussed hereinafter.

As before, the rigid fitment portion 126 and the flexible bag 122 are a single integral piece. However, the thin walled portion 124 of the flexible bag 122 is separated from the rigid fitment portion 126 by a relatively thick bag portion 123. This relatively thick portion 123 corresponds to the upper half of the body of the flexible bag 122. The combination of a relatively thin walled portion corresponding to the lower half of the flexible bag and a relatively thick walled portion corresponding to the upper half of the flexible bag provides a means for enabling substantially all of the product to be dispensed from the flexible bag when the lower half of the flexible bag inverts inside the upper half of the flexible bag which maintains it original shape. In addition, this relatively thick upper half 123 may include a series of corrugations or ridges 125 which help stiffen the upper half 123 of the flexible bag 122. Consequently, the upper half 123 of the flexible bag 122 is relatively resistant to collapse, due to the resilience provided by the greater wall thickness and the stiffening effect of the corrugations 125. Preferably, the thickness of the upper half 123 is from than about 0.025 inch to about 0.040 inch. Preferably, the corrugations have a radius of from about 0.060 inch to about 0.120 inch and are separated from each other about 0.125 inch.

In contrast, the thin walled portion 124 of this flexible bag 122 (which is the lower half 124 of the body of the flexible bag 122) is adapted to be highly susceptible to collapse. This thin walled portion 124 is substantially thinner in wall thickness than the upper half 123 of the flexible bag 122. The upper half 123 of the flexible bag 122 is substantially identical in shape (except the corrugations 125) and size to the lower half 124 thereof. Therefore, when the flexible bag 122 is fully inverted on itself (as discussed below), substantially no fluid remains between them (except for the residual left in the corrugations 125). Inversion is aided if the transition from the upper half 123 to the lower half 124 of the flexible bag 122 is substantially abrupt; therefore, this is preferable.

This flexible bag 122 is designed such that, as fluid is dispensed from the inner receptacle 120, the relatively thin, lower half 124 of the flexible bag 122 inverts into the thicker, ribbed, upper half 123 of the flexible bag 122. Consequently, the upper half 123 of the bag 122 has a thickness and shape (e.g., corrugations 125) such that the upper half 123 will maintain its substantially original shape (at least between dispensing operations) until empty. In addition, the lower half 124 of the flexible bag 122 is thin enough that it will invert inside the upper half 123 as product is dispensed therefrom. Thus, this configuration (i.e., thin lower half 124 and thick, ribbed, upper half 123) provides a means for enabling substantially all of the product therein to be dispensed. Therefore, there is no need for the diptube 36 which performs this function in the previous embodiment. A more complete discussion of the inversion process can be found in U.S. Pat. No. 4,842,165 issued to Van Coney on Jun. 27, 1989, the disclosure of which is hereby incorporated herein by reference in its entirety.

An exemplary inner receptacle 120 appearing as illustrated in FIGS. 3 and 4 may be made of low density polyethylene and have a capacity of 6.25 fl. oz. (177.4 ml). A length of approximately 6 inches (15.2 cm) and a diameter of 1.6 inches (4 cm) could provide the desired volume. Wall thickness of the thin walled portion 124 of the flexible bag 122 may vary from about 0.002 to about 0.004 inch (0.051 to 0.102 mm) except at the upper and lower ends where it could be thicker due to process parameters. Wall thickness of the upper, thicker portion 123 of the flexible bag 122 may be about 0.030 inch (0.76 mm). The corrugations 125 may have a radius of about 0.09 inch (0.22 cm). The rigid fitment portion 126 might have a flange 142 diameter of 1.71 inch (4.34 cm) and a flange thickness of 0.09 inch (0.22 cm). The cylindrical wall 30 may have a length of 0.5 inch (1.27 cm) and an outside diameter of 0.5 inch (1.27 cm) to 0.75 inch at the flared portion 34 (1.91 cm). The diameter of the fluid passage 32 could be 0.25 inch (0.64 cm) to 0.38 inch (0.97 cm) at the upper end.

Figure 8:
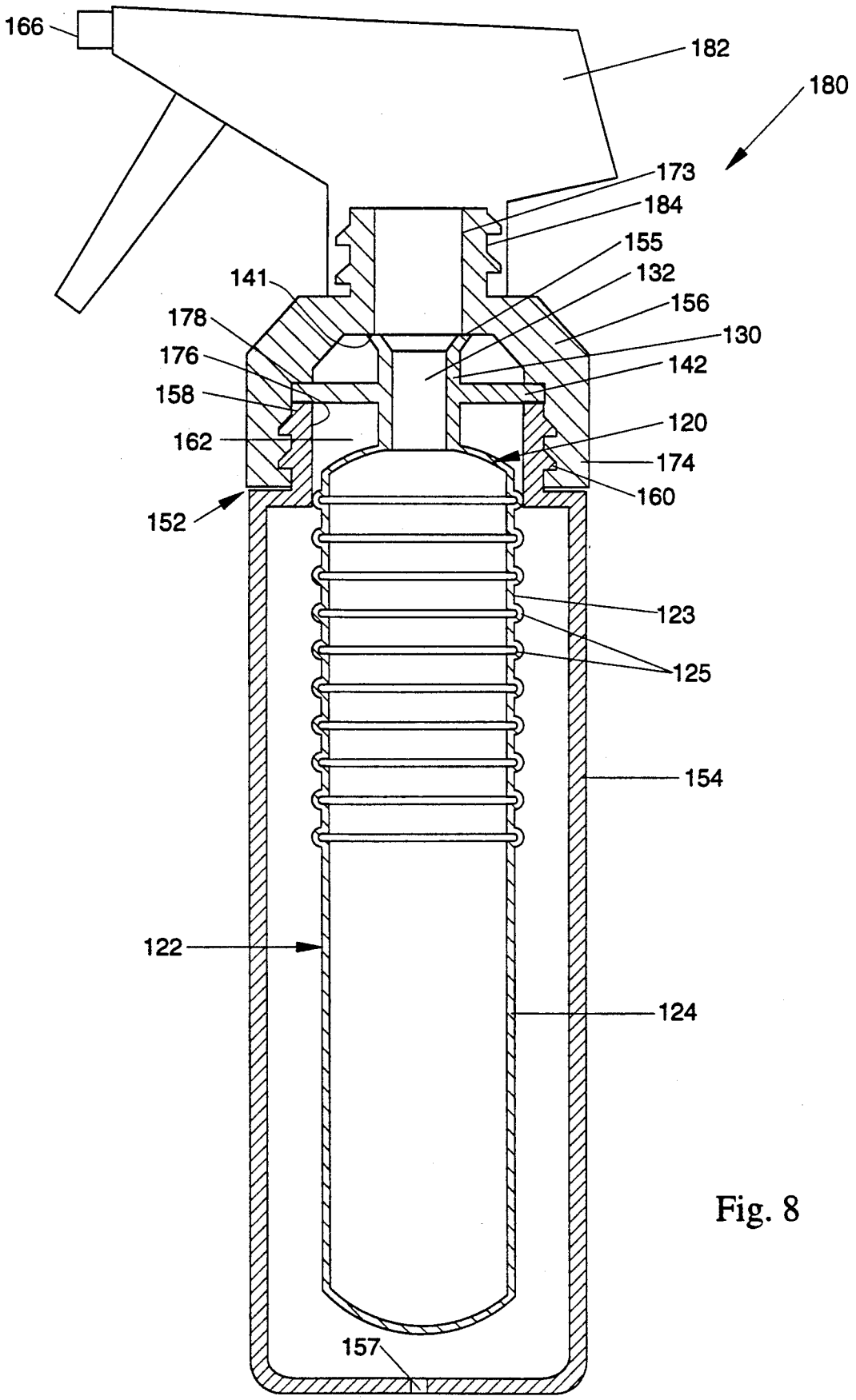
FIG. 8 is a cross-sectional elevation view similar to FIG. 5, of a trigger sprayer package utilizing the inner receptacle of FIG. 7.

Referring to FIG. 8, this second inner receptacle 120 can be advantageously utilized in a trigger sprayer package, indicated generally as 180. This trigger sprayer package 180 includes the inner receptacle 120 of FIGS. 6 and 7, and a bottle 152 including an adapter housing 156 and a commercially available trigger sprayer 182. The trigger sprayer 182 includes the following components (not seen): a valve, a trigger mechanism, a spray generator, and a threaded closure for substantially air tight connection to a reservoir bottle. An exemplary trigger sprayer 182 which may be utilized is a model T75N (non-breathable), made by Continental Sprayers, Inc., of St. Peters, Mo. Alternative fluid suction devices, such as a non-vented finger pump or mechanical pump, may also be used.

The trigger sprayer 182 is attached to the bottle 152 in a substantially air tight manner via an adaptor housing 156. The adaptor housing 156 is merely a cylindrical housing having a smaller male threaded finish 173 at its upper end and a larger female threaded portion 174 at its lower end. The smaller male threaded finish 173 of the adapter 156 cooperates with the threads 184 of the trigger sprayer 182. The larger female threaded portion 174 cooperates with the threads 160 on the bottle portion 154.

The bottle portion 154 is very similar to the bottle portion 54 of FIG. 4. It includes a threaded finish 158 with an opening 162 large enough to permit the inner receptacle 120 to freely pass through it. This bottle portion 154, however, includes an open vent hole 157 in the lower of the bottle portion 154 and does not have a vent opening 64 in the adapter 156.

Continuing with FIG. 8, once the inner receptacle 120 is placed inside the bottle 152, the adapter 156 is tightened onto the bottle portion 54. As the adapter 156 is tightened, the periphery of the flange 142 is clamped between finish surface 176 of the bottle portion 154 and a downward facing surface 178 of the adaptor 156 similar to that previously discussed. Although an air tight seal is not required at this point for this embodiment, this configuration could also be utilized to provide such a seal. In addition, as previously described a substantially air tight seal is formed between the upwardly facing surface 141 of the cylindrical wall 130 and the downward facing surface 155 of the adapter 156 if the male finish 173 utilizing the spring action of the large flange 142.

When the trigger sprayer 182 is actuated, suction is applied to the flexible bag 122 causing fluid to be lifted from the flexible bag 122, through the fluid passage 132, the discharge opening 166, and sprayed out through the trigger sprayer 182. Initially (in the upright orientation), the fluid sprayed will be air until the air inside the inner receptacle 122 is removed and the trigger sprayer 182 is primed. Once primed, fluid can be sprayed in any orientation. As fluid is dispensed, the lower half 124 of the flexible bag 122 begins to collapse and eventually inverts inside the upper half 123. As the flexible bag 122 collapses and inverts, air enters the space between the inner receptacle 122 and the bottle 154 through the open vent hole 157. The bottle 154 does not serve a containment function; it merely serves as a handle for the trigger sprayer 182, as protection for the inner receptacle 122, and as means for sealing the inner receptacle 122 to the adaptor 156 in a substantially air tight manner.

Figure 9:
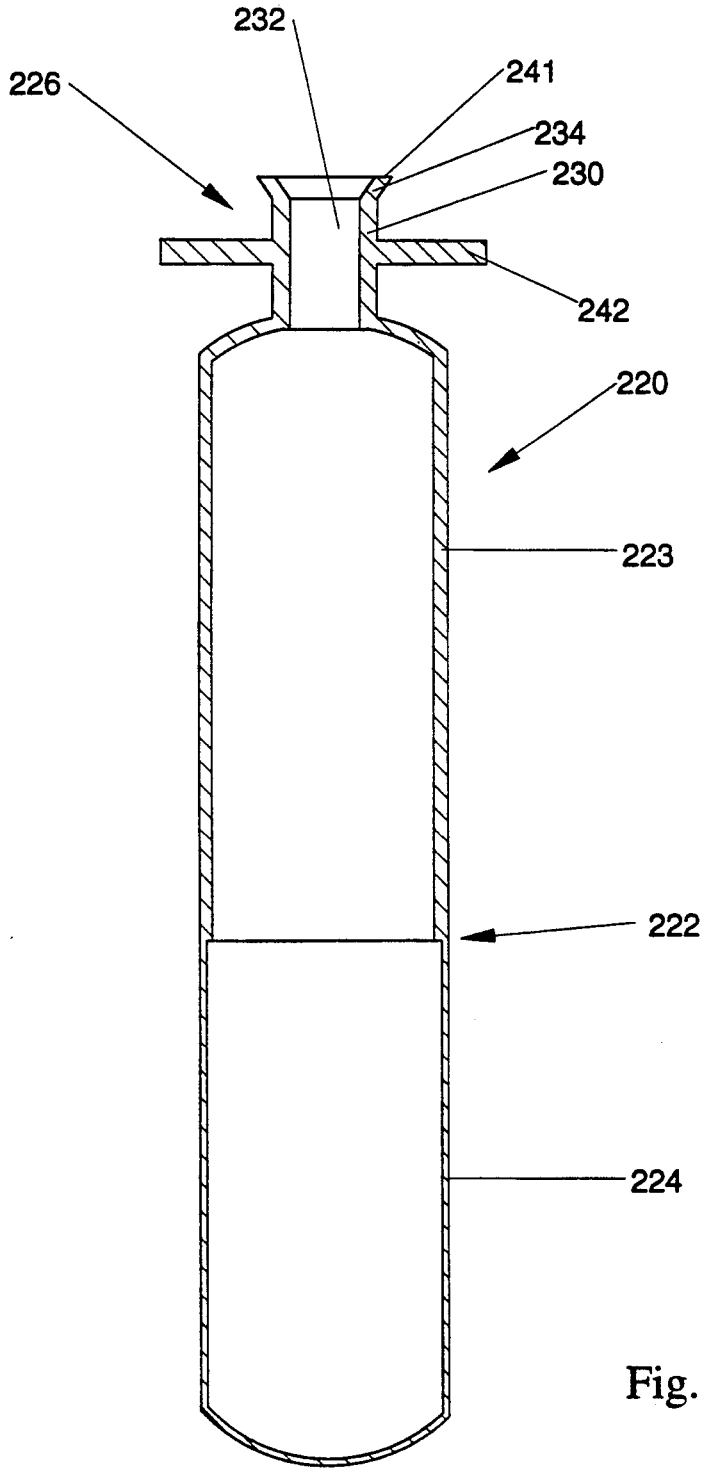
FIG. 9 is a cross-sectional elevation view similar to FIG. 7, of another preferred inner receptacle of the present invention.

Referring to FIG. 9, a third alternative inner receptacle, indicated generally as 220, is illustrated. This inner receptacle 220 is virtually identical to the inner receptacle 120 of FIG. 7. However, the upper half 223 of the flexible bag 222 of this inner receptacle 220 lacks the corrugations 125 and is slightly thicker which increases its resilience. The discussion above with respect to inner receptacle 120 is equally applicable to the inner receptacle 220.

An exemplary inner receptacle 220 appearing as illustrated in FIG. 9 may be made of low density polyethylene and have a capacity of 6.25 fl. oz. (177.4 ml). A length of approximately 6 inches (15.2 cm) and a diameter of 1.6 inches (4 cm) could provide the desired volume. Wall thickness of the thin walled portion 224 of the flexible bag 222 may vary from about 0.002 to about 0.004 inch (0.051 to 0.102 mm) except at the top and bottom ends where it could be thicker due to process parameters. Wall thickness of the upper, thicker portion 123 of the flexible bag 122 may be about 0.040 inch (0.10 cm) . The rigid fitment portion 26 might have a flange 242 diameter of 1.71 inch (4.34 cm) and a flange 242 thickness of 0.09 inch (0.22 cm). The cylindrical wall 30 may have a length of 0.5 inch (1.27 cm) and an outside diameter of 0.5 inch (1.27 cm) to 0.75 inch at the flared portion 34 (1.91 cm). The diameter of the fluid passage 32 could be 0.25 inch (0.64 cm) to 0.38 inch (0.97 cm) at the upper end.

Figure 10:
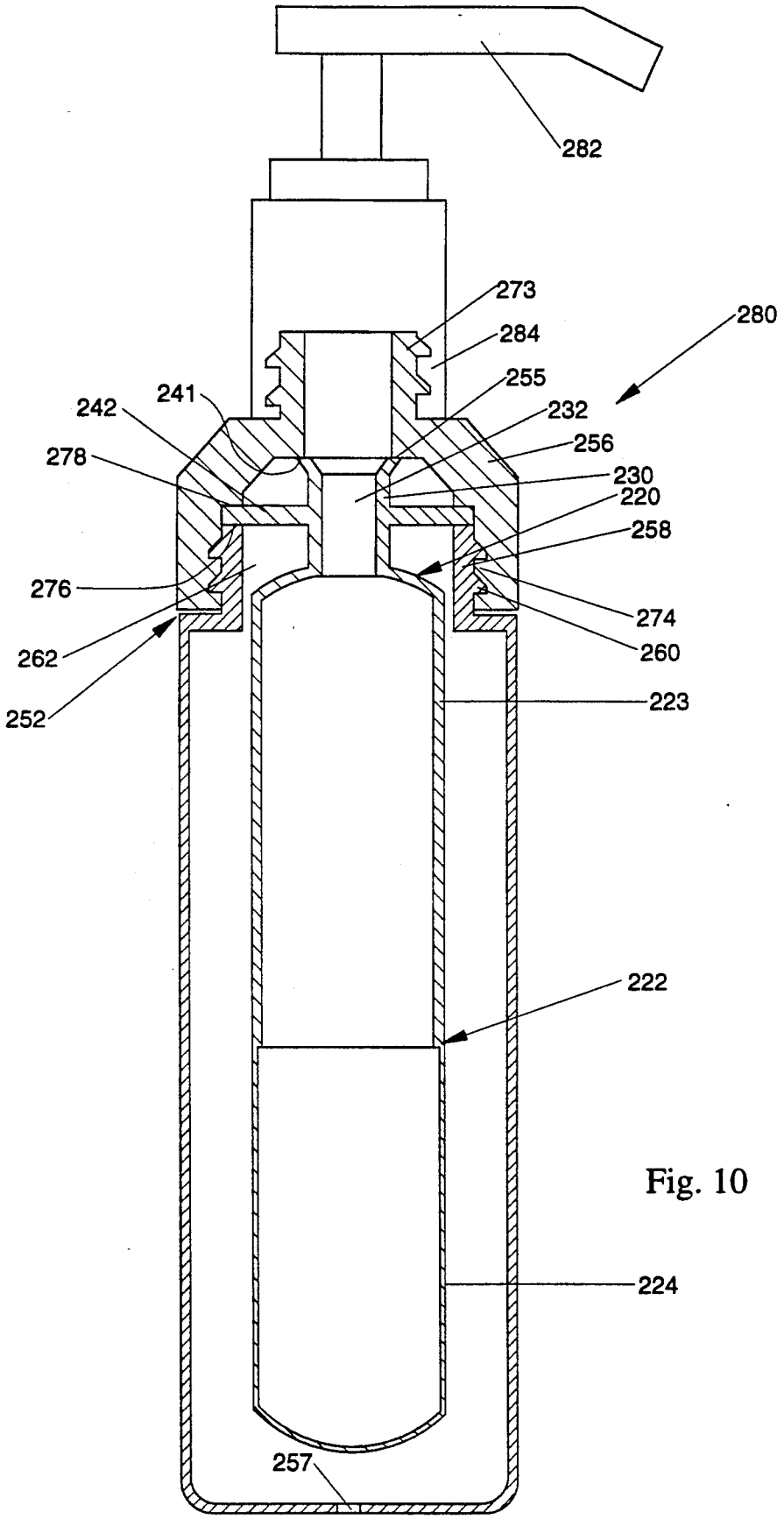
FIG. 10 is a cross-sectional elevation view similar to FIG. 8 of a finger pump package utilizing the inner receptacle of FIG. 9.

Referring to FIG. 10, this inner receptacle 220 may be advantageously utilized for example in the illustrated mechanical pump package 280. The illustrated bottle 252 is virtually identical to that of FIG. 8, except a mechanical pump 282 is utilized instead of the trigger sprayer 182. One exemplary mechanical pump may be purchased from Calmar, Inc., Watchung, N.Y., as model SD-400T. Hot melt adhesive may be used to block the vents. The flexible bag 222 of this inner receptacle 220 is designed to invert as previously described. In fact, the previous description of the package and its operation provided with regard to FIGS. 7 and 8 is applicable to this package 280 (except the mechanical pump 282 is utilized instead of the trigger sprayer 182).

Inner receptacles of the present invention are made as a single integral piece; preferably by a pressblowing process. Pressblowing is a little known commercial blowmolding process developed more than 20 years ago. The first step involves injection molding a rigid fitment portion by extruding a hollow tube into a mold. Once the mold is filled the mold moves away from the extruder as the hollow tube continues to be extruded while still connected to the rigid fitment portion. As the mold moves away the tube is simultaneously drawn. A mold then closes around the tube pinching off the lower and the tube is then blow molded.

The parameters of the process can be controlled to provide various results. For example, the rate of extrusion and the draw rate can be controlled so that flexible bags are formed which are relatively thin throughout (i.e., a flexible bag 22 such as seen in FIG. 2). Similarly, the die gap (i.e., the thickness of the tube being extruded) and the draw rate can be abruptly changed to provide flexible bags which are thicker at the upper and thinner at the lower (such as the flexible bag 122 of FIG. 7 and the flexible bag 222 of FIG. 9). The corrugations 125 of the flexible bag 122 of FIG. 7 can be added by providing the corresponding mold elements in the blow mold. For simplicity, the following pressblowing discussion will utilize the inner receptacle 20 of FIG. 2 as an exemplary inner receptacle of the present invention (although it is intended to represent any inner receptacle of the present invention).

Pressblowing machines are available commercially, for example, from Ossberger-Turbinenfabrik of Germany. Commercial pressblowing machines, however, are limited in the range of motion permitted in opening the injection mold. Therefore, only fitment portions 26 having small width variations may be molded. Consequently, it is not possible to mold fitment portions having the large flange 42. For example, A Model DUO-30 pressblower manufactured by Ossberger-Turbinenfabrik has a collet-like mechanism for opening and closing the injection mold halves, which is unable to provide the necessary range of motion. It would only permit injection molding of fitment portions 26 which have a width variation (i.e., flange 42 radius minus cylindrical wall 30 radius) of about 0.125 inch.

Figure 11:
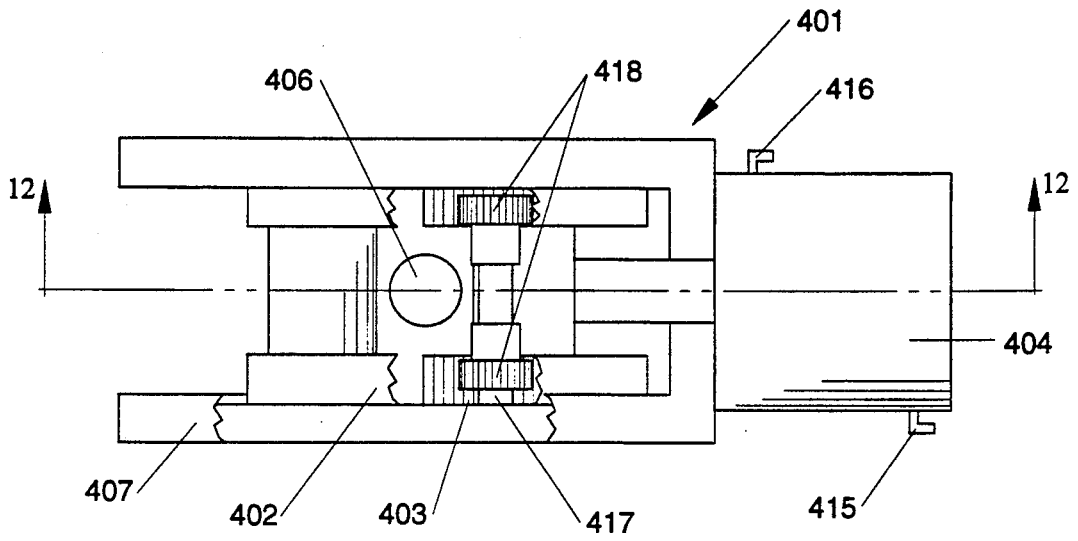
FIG. 11 is a top plan view of an improved mold opening and closing mechanism within a commercial pressblowing machine.
Figure 12:
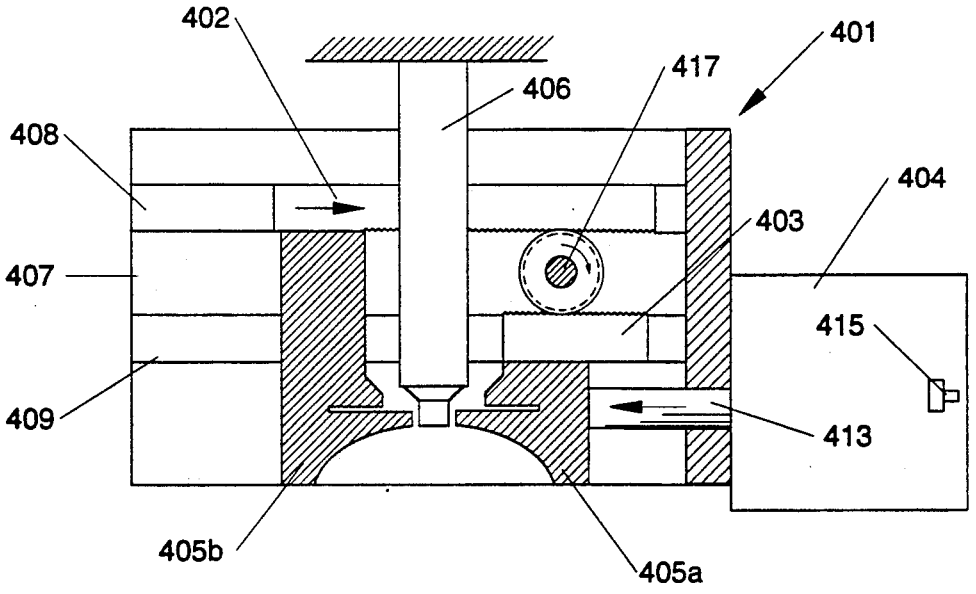
FIG. 12 is a sectioned elevation view of the improved mold mechanism of FIG. 11, taken along section line 12—12 of FIG. 11.

Referring to FIGS. 11 and 12, a Duo-30 pressblower may be modified to replace the collet mechanism with a rack and pinion mechanism, indicated generally as 401. The rack and pinion mechanism 401 allows a much greater range of lateral mold motion so that inner receptacles 20 of the present invention with their large flange 42 can be formed. The rack and pinion mechanism 401 includes an top rack unit 402 and a lower rack unit 403 driven by an air cylinder 404. The rack units, 402 and 403, are attached to injection mold halves 405*a* and 405*b* perpendicular to a mold core pin 406 axis. (These injection mold halves 405*a* an 405*b* also include a small portion of the upper half of the blow mold.) The rack and pinion mechanism 401 has a slotted frame 407 with an upper set 408 and a lower set 409 of opposing slots for holding upper and lower rack units, 402 and 403, respectively.

The upper rack unit 402 slides in the upper pair of opposing slots 408 and the bottom rack unit 403 slides in the lower pair of opposing slots 409. The bottom rack unit 403 is attached to injection mold half 405*a* and the top rack unit 402 is attached to injection mold half 405*b* . Injection mold halves 405*a* and 405*b* are shown open at either side of the core pin 406. Injection mold half 405*a* is connected to an air cylinder rod 413, extending through the closed end of the slotted frame 407. The air cylinder 414 is attached to the frame 407 and moves the cylinder rod 413 linearly when activated by an air supply (not seen) to ports 415 and 416 from a cylinder control circuit (not seen). A fixed position shaft 417 extends between the sides of the slotted frame 407 from bearings or bushings (not seen) mounted in the frame 407. Pinned to the shaft 417 is a pair of pinion gears 418 located between and in engagement with the upper rack unit 402 and the lower rack unit 403.

Arrows in FIG. 13 indicate the motion to close the injection mold halves 405*a* and 405*b* . The air cylinder rod 413 moves the right mold half 405*a* to the left. This motion is transferred to the left mold half 405*b* via the rack and pinion mechanism 401 to cause the left mold half 405*b* to move toward the right. The lower rack 403 causes the pinion gears 418 and the shaft 417 to rotate clockwise. The pinion gears 418, engaged with the lower rack unit 403, moves the upper rack unit 402 to the right. The injection mold halves 405*a* and 405*b*, are thereby driven closed. The reverse motions open the mold halves 405*a* and 405*b* . This mechanism 401 is one means of opening and closing injection mold halves 405*a* and 405*b* perpendicular to the core pin 412 in order to handle large diameter flanged items like the fitment portion 26 utilized on inner receptacles 20 of the present invention.

Although particular embodiments of the present invention have been shown and described, modification may be made to the inner receptacle without departing from the teachings of the present invention. Accordingly, the present invention comprises all embodiments within the scope of the appended claims.

What we claim is:

1. A replaceable inner receptacle for use in an outer bottle having a finish portion wherein the replaceable inner receptacle comprises a single integral piece flexible bag adapted to contain a fluid product and including:

a. a thin walled lower half portion having a thickness small enough that the thin walled portion readily collapses after being radially deflected under an externally supplied squeeze force;

b. a thick walled upper half portion having a thickness great enough to be resiliently deformable such that after being radially deflected under an externally supplied squeeze force, the upper portion of the flexible bag returns substantially to its original shape; and c. a rigid fitment portion having a fluid passage therethrough providing fluid communication with the interior of the flexible bag and including a flange having an overall dimension greater than both the upper and lower walled of the walled portion of the flexible bag, and the periphery of the flange being adapted to rest against the finish portion of the outer bottle;

wherein the thin walled half portion of the flexible bag inverts inside the thick walled upper portion of the flexible bag enabling substantially all of the fluid product within the flexible bag to be dispensed.

2. A replaceable inner receptacle according to claim 1, wherein the upper half of the flexible bag includes corrugations.

3. A replaceable inner receptacle according to claim 1 wherein the rigid fitment portion additionally comprises a grasping portion extending above the flange to provide a means for grasping and removing the inner receptacle from the bottle.

4. A replacement inner receptacle according to claim 1, wherein the outer bottle used with the receptacle includes a closure having a dispensing orifice, wherein when the closure is engaged with the bottle finish, said receptacle flange acts as a spring to provide a substantially fluid tight communication between the fluid passage and the dispensing orifice.

5. A replacement inner receptacle according to claim 4, wherein the closure is an adaptor housing capable of engaging a commercially available sprayer selected from the group consisting of a trigger sprayer, a non-vented finger pump, and a mechanical pump.

6. A replaceable inner receptacle according to claim 1, further comprising a peelable film tear tab applied to said rigid fitment portion for sealing the fluid passage of the rigid fitment portion wherein the peelable tear tab is manually removable.

* * * * *

UNITED STATES PATENT AND TRADEMARK OFFICE

CERTIFICATE OF CORRECTION

PATENT NO. : 5,305,921

DATED : April 26, 1994

INVENTOR(S) : KOCK ET AL.

It is certified that error appears in the above-indentified patent and that said Letters Patent is hereby corrected as shown below:

*Column 1, line 55, after "connections" delete – lo –.*

*Column 1, line 55, after "connections" insert – , –.*

*Column 2, line 16, delete "provided" and insert therefor – provides –.*

*Column 2, line 33, delete "provided" and insert therefor – provides –.*

*Column 12, line 34, delete "walled" and insert therefor – walls –.*

*Column 12, line 38, after "walled", insert therefor – lower –.*

Signed and Sealed this

Sixth Day of June, 1995

Bruce Lehman

*Attest:*

BRUCE LEHMAN

*Attesting Officer*

*Commissioner of Patents and Trademarks*